US010084288B2

(12) United States Patent
Uegaki et al.

(10) Patent No.: US 10,084,288 B2
(45) Date of Patent: Sep. 25, 2018

(54) SPARK PLUG

(71) Applicant: NGK SPARK PLUG CO., LTD., Nagoya, Aichi (JP)

(72) Inventors: Hironori Uegaki, Nagoya (JP); Seiji Nakano, Kasugai (JP); Hirokazu Kurono, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/738,650

(22) PCT Filed: Jun. 2, 2016

(86) PCT No.: PCT/JP2016/002666
§ 371 (c)(1),
(2) Date: Dec. 21, 2017

(87) PCT Pub. No.: WO2016/208128
PCT Pub. Date: Dec. 29, 2016

(65) Prior Publication Data

US 2018/0183216 A1 Jun. 28, 2018

(30) Foreign Application Priority Data

Jun. 22, 2015 (JP) ..... 2015-124317

(51) Int. Cl.
*H01T 13/34* (2006.01)
*H01T 13/41* (2006.01)
*H01T 13/32* (2006.01)

(52) U.S. Cl.
CPC ..... *H01T 13/34* (2013.01); *H01T 13/32* (2013.01); *H01T 13/41* (2013.01)

(58) Field of Classification Search
CPC ..... H01T 13/34; H01T 13/32; H01T 13/41
See application file for complete search history.

(56) References Cited

U.S. PATENT DOCUMENTS 6,583,537 B1 6/2003 Honda et al.
2007/0290594 A1* 12/2007 Hoffman ..... H01T 13/41 313/142

(Continued)

FOREIGN PATENT DOCUMENTS

JP S58-189917 A 11/1983
JP H11-214119 A 8/1999

(Continued)

OTHER PUBLICATIONS

Japan Patent Office, International Search Report issued in corresponding Application No. PCT/JP2016/002666, dated Aug. 2, 2016.

(Continued)

*Primary Examiner* — Kevin Quarterman
(74) *Attorney, Agent, or Firm* — Stites & Harbison, PLLC; Jeffrey A. Haeberlin

(57) ABSTRACT

A spark plug including a metallic shell having a ground electrode, an insulator held inside the metallic shell and having an axial hole having a small diameter portion, an intermediate diameter portion connected to a rear end of the small diameter portion via a step portion, and a large diameter portion disposed on the rear side of the intermediate diameter portion, a resistor disposed inside the large diameter portion, a center electrode having a flange portion which bulges in a radial direction inside the intermediate diameter portion and comes into contact with the step portion and a leg portion which extends forward from the flange portion and is disposed inside the small diameter portion, and a seal disposed on the rear side of the step portion and electrically connecting the center electrode and the resistor. The rear end of the seal is located inside the intermediate diameter portion.

4 Claims, 6 Drawing Sheets

(56) References Cited

U.S. PATENT DOCUMENTS

| | | | |
|---|---|---|---|
| 2013/0285534 | A1 | 10/2013 | Ochiai et al. |
| 2013/0307402 | A1 | 11/2013 | Yoshida et al. |

FOREIGN PATENT DOCUMENTS

| | | | |
|---|---|---|---|
| JP | 2009-541916 | A | 11/2009 |
| JP | 2015-099765 | A | 5/2015 |
| WO | 2012-105255 | A1 | 8/2012 |

OTHER PUBLICATIONS

Japan Patent Office, Written Opinion issued in corresponding Application No. PCT/JP2016/002666, dated Aug. 2, 2016.

* cited by examiner

SPARK PLUG

TECHNICAL FIELD

The present invention relates to a spark plug.

BACKGROUND ART

A spark plug is a component which generates spark discharge in order to ignite an air-fuel mixture inside a combustion chamber. As a structure of the spark plug, there is known a structure which includes an insulator internally having an axial hole extending along an axis of the insulator, a metallic shell for internally holding the insulator, a center electrode held inside the axial hole, and an electrically conductive seal for holding the center electrode inside the axial hole (refer to Patent Document 1). In the case of the structure disclosed in Patent Document 1, the center electrode includes a flange portion which bulges in a radial direction, and a head portion which protrudes rearward from the flange portion. This structure is utilized so as to hold the center electrode in the insulator. Specifically, the flange portion is brought into contact with a step portion provided in the axial hole, thereby restraining forward movement of the center electrode. Furthermore, a space around the head portion and the flange portion is filled with a seal so as to ensure the impact resistance of the center electrode. In this manner, even if the center electrode receives an impact due to the combustion, the center electrode is less likely to loosen.

PRIOR ART DOCUMENT

Patent Document

Patent Document 1: International Publication No. WO2012/105255

SUMMARY OF THE INVENTION

Problem to be Solved by the Invention

The spark plug needs to have electrode durability against repeated spark discharge. An effective way to improve this durability is to reduce the capacitance between the metallic shell and a conductor disposed inside the insulator. This conductor is the seal or the center electrode. The capacitance can be reduced by, for example, shortening the head portion and lowering the height of the seal in the axial direction in the same amount as the head portion is shortened. However, if the head portion is shortened, the holding power of the seal is weakened. Consequently, the impact resistance of the center electrode decreases, and the center electrode is likely to loosen. In view of the above-described circumstances, the present invention aims to simultaneously realize reduction of capacitance and securing of the impact resistance of a center electrode.

Means for Solving the Problem

The present invention has been accomplished in order to solve the above-described problems, and can be realized in the following modes.

(1) According to one mode of the present invention, there is provided a spark plug comprising: an approximately tubular metallic shell having a ground electrode at its forward end; a tubular insulator which is held inside the metallic shell and has an axial hole formed therein and having a small diameter portion, an intermediate diameter portion which is larger in diameter than the small diameter portion and is connected to a rear end of the small diameter portion via a step portion, and a large diameter portion which is larger in diameter than the intermediate diameter portion and is disposed on a rear side of the intermediate diameter portion; a resistor which is at least partially disposed inside the large diameter portion; a center electrode which has a flange portion which bulges in a radial direction inside the intermediate diameter portion and is in contact with the step portion, and a leg portion which extends forward from the flange portion and is disposed inside the small diameter portion; and an electrically conductive seal which is disposed on a rear side of the step portion and electrically connects the center electrode and the resistor. This spark plug is characterized in that a rear end of the seal is located inside the intermediate diameter portion. According to this mode, the large diameter portion is not filled with a sealing material. Accordingly, it is possible to avoid a decrease in the distance between the sealing material and the metallic shell. Therefore, capacitance is reduced, whereby the durability of the electrode is improved.

(2) In the above-described mode, the center electrode may have a protruding portion located on a rear side of the rear end of the seal, and the protruding portion may be buried in the resistor. According to this mode, even when the capacitance is reduced by shortening the length of the seal, the impact resistance of the center electrode can be secured, because the protruding portion is buried in the resistor.

(3) In the above-described mode, a surface of the protruding portion may contain, in a largest amount, a metal whose main component is any one of zinc, tin, lead, rhodium, palladium, platinum, copper, gold, antimony, and silver, or a nickel alloy containing boron or phosphorus. According to this mode, the electrical connection between the resistor and the center electrode is improved. As a result, the generation of heat at the interface between the resistor and the center electrode is restrained, whereby the durability of the resistor is improved.

(4) In the above-described mode, a rear end of the center electrode may be disposed inside the large diameter portion. Since the resistor is larger in electrical resistance than the center electrode, only a small amount of current flows through a portion of the resistor located on the forward side of the rear end of the center electrode. In the case of this mode, since the rear end of the center electrode is disposed inside the large diameter portion, only a small amount of current flows through a portion of the resistor disposed in the intermediate diameter portion. That is, in the resistor, only a small amount of current flows through its portion disposed in the intermediate diameter portion whose cross-sectional area is smaller than that of the large diameter portion and whose current density is higher than that of the large diameter portion. As a result, the generation of heat is restrained, whereby the durability of the resistor is improved.

(5) In the above-described mode, a distance from a forward-side end portion of the resistor to a forward end of the large diameter portion may be equal to or shorter than 20% of a distance from the forward end of the large diameter portion to a rear-side end portion of the resistor. According to this mode, the durability of the resistor is improved. In a portion of the resistor whose cross-sectional area is small, the amount of generated heat increases due to an increase in current density. A portion whose temperature increases due to an increased amount of generated heat may deteriorate in durability. In the case of this mode, the length of the portion of the resistor, which portion extends from the forward-side end portion of the resistor to the above-described boundary; i.e., the length of the portion of the resistor disposed in the intermediate diameter portion, is equal to or shorter than 20% of the length of the portion of the resistor, which portion extends from the above-described boundary to the rear-side end portion of the resistor; i.e., the length of the portion of the resistor disposed in the large diameter portion. Accordingly, the length of the portion of the resistor disposed in the intermediate diameter portion is shorter. Consequently, the generation of heat in the intermediate diameter portion is restrained, whereby the above-described advantageous effect can be obtained.

The present invention can be realized in various modes in addition to the above-described modes. For example, the present invention can be realized as a method of manufacturing the spark plug.

MODES FOR CARRYING OUT THE INVENTION

Figure 1:
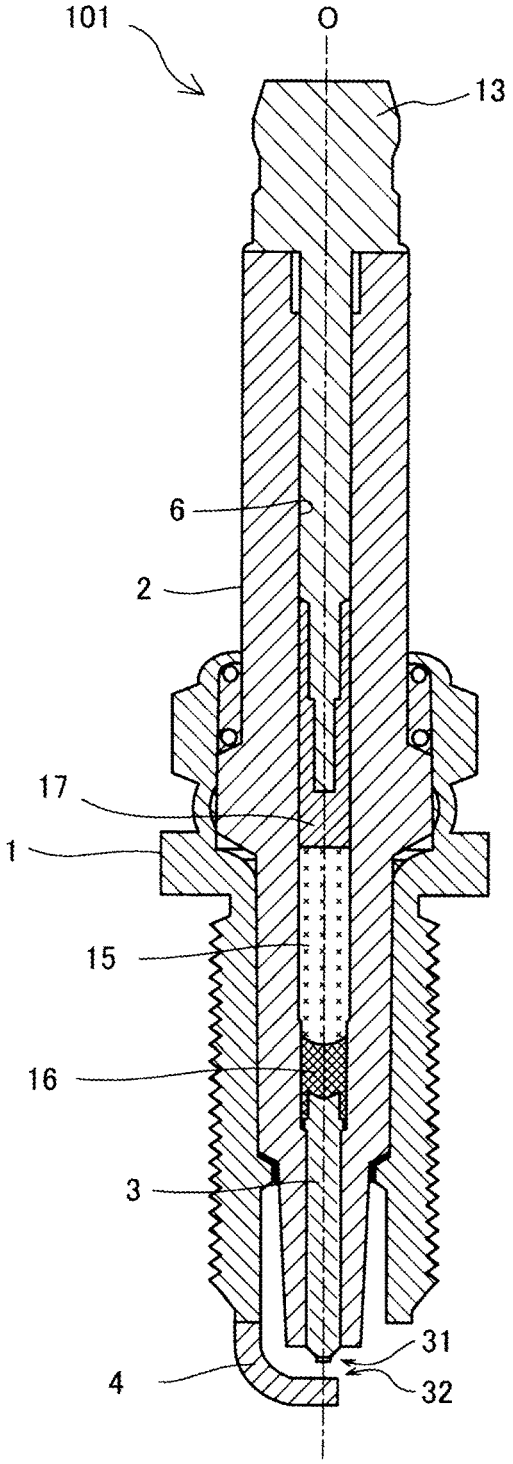
FIG. 1 Sectional view illustrating a spark plug.

FIG. 1 is a sectional view illustrating a spark plug 101. The spark plug 101 has a metallic shell 1, an insulator 2, a center electrode 3, a ground electrode 4, and a metallic terminal 13. In FIG. 1, the longitudinal axis of the spark plug 101 is represented by an axial line O. In addition, the ground electrode 4 side along the axial line O is referred to as a forward side of the spark plug 101, and the metallic terminal 13 side along the axial line O is referred to as a rear side.

The metallic shell 1 is formed of metal such as carbon steel in a hollow cylindrical shape and constitutes a housing of the spark plug 101. The insulator 2 is formed of a ceramic sintered body, and its forward end portion is accommodated inside the metallic shell 1. The insulator 2 is a tubular member and has an axial hole 6 formed therein along the axial line O. A portion of the metallic terminal 13 is inserted into and fixed to one end of the axial hole 6, and the center electrode 3 is inserted into and fixed to the other end of the axial hole 6. In addition, inside the axial hole 6, the resistor 15 is disposed between the metallic terminal 13 and the center electrode 3. Opposite end portions of the resistor 15 are electrically connected to the center electrode 3 and the metallic terminal 13, respectively, via an electrically conductive glass seal layer 16 and a metallic terminal-side conductive glass seal layer 17, respectively.

The resistor 15 functions as an electrical resistor between the metallic terminal 13 and the center electrode 3, thereby restraining generation of radio noise (noise) during spark discharge. The resistor 15 is formed of ceramic powder, an electrically conductive material, glass, and a binder (adhesive). In the present embodiment, the resistor 15 is manufactured through a manufacturing procedure described later.

The center electrode 3 has an ignition portion 31 formed at the forward end, and is disposed in the axial hole 6 in a state where the ignition portion 31 is exposed. The ground electrode 4 is welded at one end to the metallic shell 1. A portion of the ground electrode 4 at the other end is laterally bent such that a distal end portion 32 of the ground electrode 4 faces the ignition portion 31 of the center electrode 3 while leaving a gap therebetween.

A thread 5 is formed on the outer periphery of the metallic shell 1 of the spark plug 101 having the above-described configuration. The spark plug 101 is mounted on a cylinder head of an engine by using the thread 5.

Figure 2:
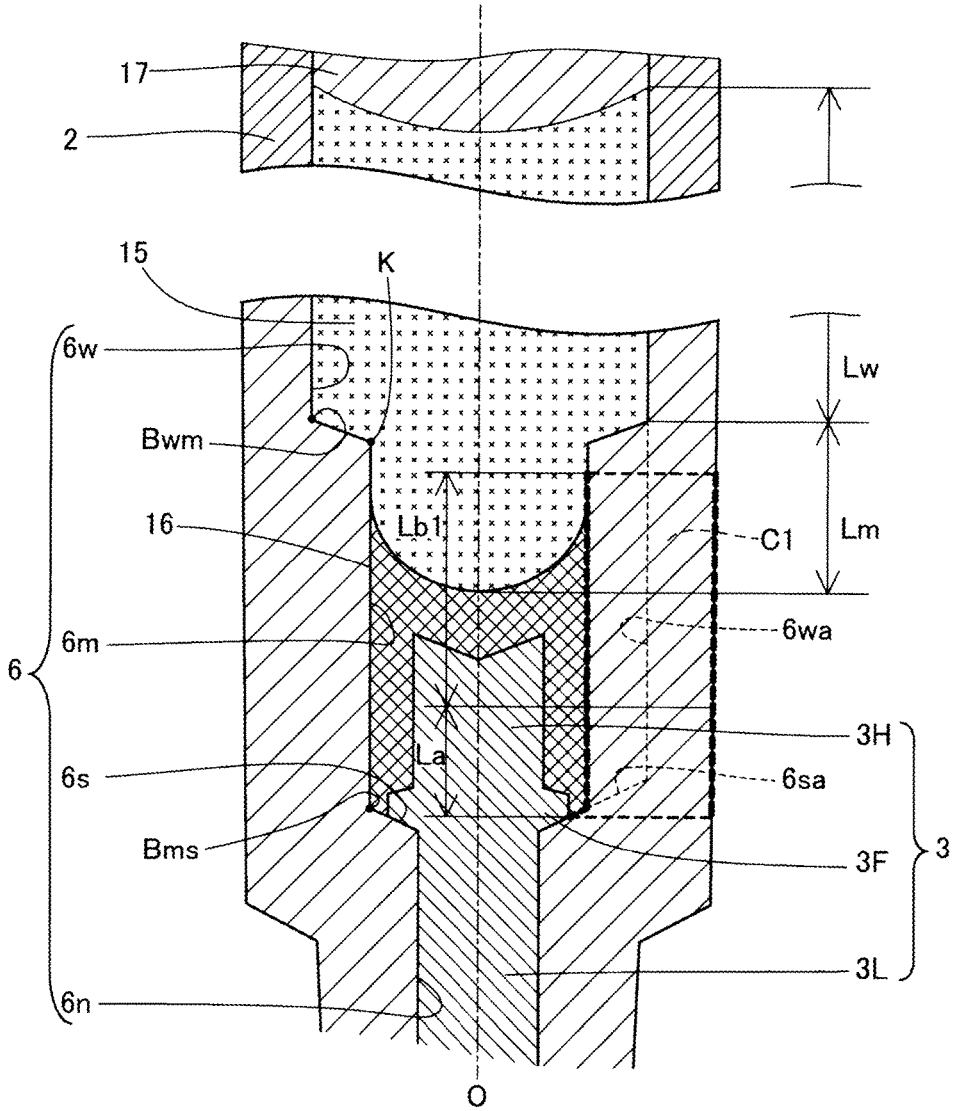
FIG. 2 Enlarged sectional view illustrating an electrically conductive glass seal layer and its vicinity.

FIG. 2 is an enlarged sectional view illustrating the electrically conductive glass seal layer 16 and its vicinity. The axial hole 6 includes a large diameter portion 6*w*, an intermediate diameter portion 6*m*, and a small diameter portion 6*n*. The large diameter portion 6*w* has an inner diameter larger than that of the intermediate diameter portion 6*m*. The intermediate diameter portion 6*m* has an inner diameter larger than that of the small diameter portion 6*n*. The intermediate diameter portion 6*m* has a step portion 6*s* and is connected to the rear end of the small diameter portion 6*n* via the step portion 6*s*.

Each of the large diameter portion 6*w* and the small diameter portion 6*n* has an approximately ideal cylindrical inner circumferential surface. However, the inner circumferential surfaces of the large diameter portion 6*w* and the small diameter portion 6*n* may be inclined due to die removal during manufacturing. The boundary between the large diameter portion 6*w* and the intermediate diameter portion 6*m* is a position where the diameter starts to decrease beyond the degree of decrease in the diameter due to the above-described inclination. In the present embodiment, the position is represented by a boundary Bwm shown in FIG. 2. Here, the decrease in the diameter means that the diameter decreases from the rear side toward the forward side.

The step portion 6*s* has a conical surface of an approximately ideal truncated cone. The rear end of the step portion 6*s* is a position where an increase in the diameter due to the conical surface stops. In the present embodiment, the position is represented by a boundary Bms shown in FIG. 2. Here, the increase in the diameter means that the diameter increases from the forward side toward the rear side.

The above description of "the large diameter portion 6*w* has an inner diameter larger than that of the intermediate diameter portion 6*m*" may be paraphrased into any one of the following. 1. "The average inner diameter of the large diameter portion 6*w* is larger than the average inner diameter of the intermediate diameter portion 6*m*." 2. "The minimum value of the inner diameter of the large diameter portion 6*w* is greater than the maximum value of the inner diameter of the intermediate diameter portion 6*m* in a region where the wall surface of the intermediate diameter portion 6*m* is in contact with the electrically conductive glass seal layer 16." 3. "The minimum value of the inner diameter of the large diameter portion 6*w* is equal to or smaller than the maximum value of the inner diameter of the intermediate diameter portion 6*m*." The reason for describing "equal to or smaller than" in the above-described item 3 is that both the minimum value of the inner diameter of the large diameter portion 6*w* and the maximum value of the inner diameter of the intermediate diameter portion 6*m* are their values obtained at the boundary Bwm and both the values coincide with each other.

The intermediate diameter portion 6*m* can also be regarded as a portion which connects the large diameter portion 6*w* and the small diameter portion 6*n* to each other.

The inner diameter at the boundary Bwm is larger than the inner diameter at the boundary Bms. Accordingly, at least a portion of the intermediate diameter portion 6*m* is tapered such that its diameter decreases toward the forward end. In the case of the spark plug 101, as illustrated in FIG. 2, the diameter decreases toward the forward end mainly in a region extending from the rear end of the step portion 6*s* to the forward end thereof and in a region extending from the boundary Bwm to a corner portion K.

The center electrode 3 includes a flange portion 3F, a leg portion 3L, and a head portion 3H. The flange portion 3F extends in the radial direction inside the intermediate diameter portion 6*m*, and abuts against the step portion 6*s*. The leg portion 3L extends forward from the flange portion 3F and is disposed inside the small diameter portion 6*n*. The head portion 3H extends rearward from the flange portion 3F.

The electrically conductive glass seal layer 16 is disposed inside the intermediate diameter portion 6*m*. That is, both the forward end and the rear end of the electrically conductive glass seal layer 16 are located inside the intermediate diameter portion 6*m*. Accordingly, the electrically conductive glass seal layer 16 is not disposed in the large diameter portion 6*w*.

Herein, the capacitance of a capacitor formed in a region extending from the forward end of the electrically conductive glass seal layer 16 to the rear end of the resistor 15 will be described. This capacitor is formed between the metallic shell 1 and a conductor (hereinafter, referred to as an internal conductor) disposed in the axial hole 6. The internal conductor in the present embodiment is the electrically conductive glass seal layer 16. Hereinafter, the above-described capacitance is denoted by C with a number (1 or 2) indicating the embodiment added as a suffix. For example, in case of Embodiment 1, the capacitance is expressed as capacitance C1.

In general, the capacitance C of the capacitor having a coaxial cylinder shape is calculated as $C=2\pi\varepsilon L/\log(b/a)$. Here, "L" represents the length in the axial direction of the cylinder, "ε" represents a relative dielectric constant, "a" represents the inner diameter of the cylinder, and "b" represents the outer diameter of the cylinder. Therefore, if the outer diameter b is constant, as the inner diameter a decreases, the capacitance C decreases.

The large diameter portion 6*wa* illustrated in FIG. 2 indicates the large diameter portion present in a comparative example which does not include the intermediate diameter portion 6*m*. The step portion 6*sa* illustrated in FIG. 3 indicates the step portion present in the comparative example, which is a portion of the large diameter portion 6*wa*. The step portion 6*sa* in the comparative example is a portion of the large diameter portion 6*wa* and connects the large diameter portion 6*wa* and the small diameter portion 6*n* to each other.

In the case of this comparative example, the electrically conductive glass seal layer 16 is charged so as to come into contact with the wall surface of the large diameter portion 6*wa*. Therefore, the outer diameter of the electrically conductive glass seal layer 16 which corresponds to the above-described inner diameter a increases, and the capacitance increases accordingly. In the present embodiment, as compared with the comparative example, the outer diameter of the electrically conductive glass seal layer 16 decreases. Therefore, the capacitance C1 also decreases.

A distance Lm illustrated in FIG. 2 represents a distance from the forward-side end portion of the resistor 15 to the forward end of the large diameter portion 6*w* in the direction of the axial line O. A distance Lw illustrated in FIG. 2 represents a distance from the forward end of the large diameter portion 6*w* to the rear-side end portion of the resistor 15. In the present embodiment, a ratio of the distance Lm/the distance Lw (hereinafter, this ratio is referred to as a distance ratio) is set to 20%.

Here, test results obtained by examining the relationship between the distance ratio and load life characteristics will be described. A load life test was carried out under test conditions prescribed in 7.14 of JIS B8031: 2006 (Internal Combustion Engine—Spark Plug). Then, in order to evaluate one type of samples, ten samples having the same configuration were prepared and a test operation was performed for each sample for 100 hours. Then, of the ten samples, samples whose resistance change rates were less than 50% were determined to be acceptable, and samples whose resistance change rates were 50% or greater were determined to be unacceptable. The resistance is the electric resistance between the metallic terminal 13 and the center electrode 3 and was measured in accordance with 7.13 of JIS B8031: 2006. The resistance change rate is the ratio of the difference between the resistances before and after the test to the resistance before the test.

The test results showed that in the case of the sample type whose distance ratio was 10% or 20%, all ten samples were determined to be acceptable. In contrast, in the case of the sample type whose distance ratio was 25%, 30%, or 50%, all of the ten samples were determined to be unacceptable. The test was also carried out for the above-described comparative example, and the test results showed that all ten samples were acceptable.

The above-described test results will be described. If the cross-sectional area of the resistor 15 decreases, the density of current flowing during discharge increases. If the current density increases, the electrical load increases, thereby leading to a deterioration in durability. Accordingly, the distance Lm is preferably as short as possible. Therefore, a test was carried out in which the distance ratio was changed while the distance Lw was used as a reference. As described above, the samples were determined to acceptable if the distance ratio was 20% or smaller. Therefore, in the present embodiment, the distance ratio was set to 20%.

Since lengths La and Lb1 shown in FIG. 2 are used for a description made for comparison with Embodiment 2, they will be described in Embodiment 2.

Figure 3:
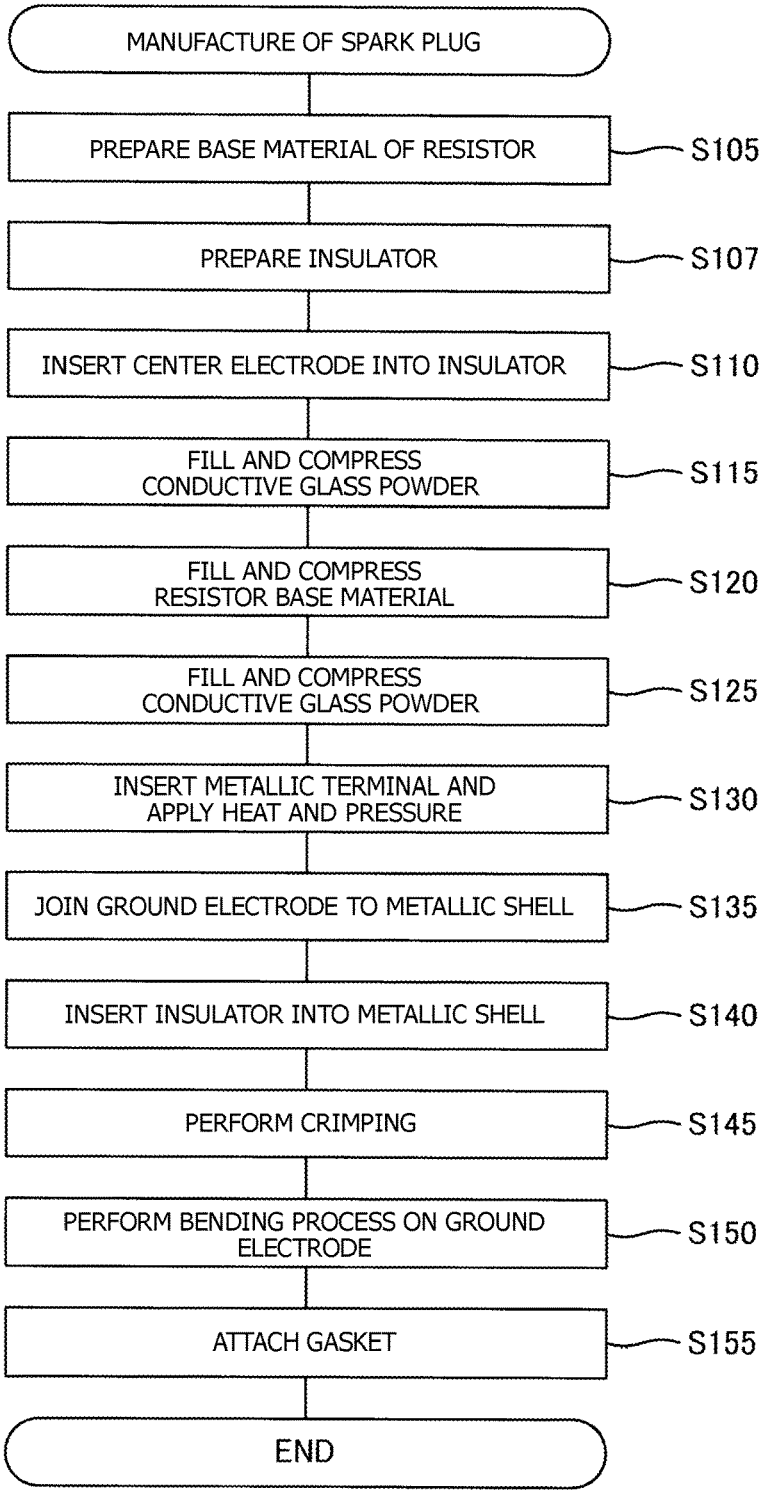
FIG. 3 Flowchart illustrating a procedure of manufacturing the spark plug.

FIG. 3 is a flowchart illustrating a procedure of manufacturing the spark plug. First, a base material of the resistor 15 is manufactured (S105).

Figure 4:
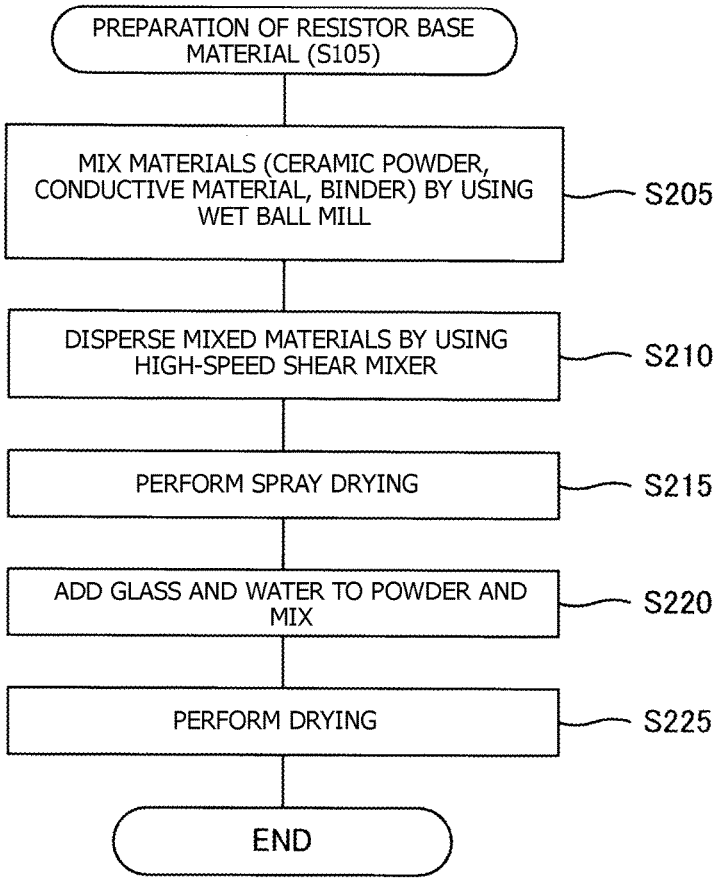
FIG. 4 Flowchart illustrating a procedure of manufacturing a base material of a resistor.

FIG. 4 is a flowchart illustrating a procedure of manufacturing the base material of the resistor 15. First, materials are mixed using a wet ball mill (S205). These materials are ceramic powder, an electrically conductive material, and a binder. For example, the ceramic powder is ceramic powder containing $ZrO_2$ and $TiO_2$. For example, the electrically conductive material is carbon black. For example, the binder (organic binder) is a dispersant such as a polycarboxylic acid. Water serving as a solvent is added to these materials, and all are mixed and stirred using the wet ball mill. At that time, although the materials are mixed together, the degree of dispersion of the materials is relatively low.

Next, the mixed materials are dispersed using a high-speed shear mixer (S210). The high-speed shear mixer mixes the materials while greatly dispersing the materials by using a strong shearing force generated by blades (stirring blades). For example, the high-speed shearing mixer is an axial mixer.

Next, the materials obtained in S210 are immediately granulated using a spray drying method (S215). Water and glass powder (coarse glass powder) are added to the powder obtained in S215, followed by mixing (S220) and drying (S225). As a result, the base material (powder) of the resistor 15 is completed. For example, as a mixer used in the mixing in S220 described above, a universal mixer can be used.

Next, the insulator 2 is manufactured (S107). Specifically, first, the outer peripheral shape of the insulator 2 and the shape of the axial hole 6 including the large diameter portion 6*w*, the intermediate diameter portion 6*m*, and the small diameter portion 6*n* are formed by means of molding. Thereafter, the wall surface of the axial hole 6 may be finished by means of cutting.

Next, the center electrode 3 is inserted into the axial hole 6 of the insulator 2 (S110). The axial hole 6 is filled with the electrically conductive glass powder, and the conductive glass powder is compressed (S115). For example, this compression is realized in such a way that a bar-shaped jig is inserted into the axial hole 6 so as to press the electrically conductive glass powder filling the axial hole 6. A layer of the electrically conductive glass powder formed in S115 is subjected to a heat compression process (to be described later), thereby forming the electrically conductive glass seal layer 16. For example, the electrically conductive glass powder is obtained by mixing copper powder and calcium borosilicate glass powder.

Next, the axial hole 6 is filled with the base material (powder) of the resistor 15, and the base material is compressed (S120). The axial hole 6 is further filled with the electrically conductive glass powder, and the conductive glass powder is compressed (S125). The powder layer formed in S120 is subjected to the heat compression process (to be described later), thereby forming the resistor 15. Similarly, the powder layer formed in S125 is subjected to the heat compression process (to be described later), thereby forming the metallic terminal-side conductive glass seal layer 17. The electrically conductive glass powder used in S125 is the same powder as the electrically conductive glass powder used in S115. In addition, the compression method used in S120 and S125 is the same method as the compression method used in S115.

A portion of the metallic terminal 13 is inserted into the axial hole 6, and a predetermined pressure is applied thereto from the metallic terminal 13 side while the insulator 2 is entirely heated (S130). Through this heat compression process, the materials filling the axial hole 6 are compressed and fired. In this manner, the electrically conductive glass seal layer 16, the metallic terminal-side conductive glass seal layer 17, and the resistor 15 are formed inside the axial hole 6.

The ground electrode is joined to the metallic shell 1 (S135), the insulator 2 is inserted into the metallic shell 1 (S140), and the metallic shell 1 is crimped (S145). As a result of the crimping in S145, the insulator 2 is fixed to the metallic shell 1. Next, the distal end of the ground electrode joined to the metallic shell 1 is subjected to a bending process (S150), whereby the ground electrode 4 is completed. Thereafter, a gasket (not illustrated) is attached to the metallic shell 1 (S155). Thus, the spark plug 101 is completed.

Figure 5:
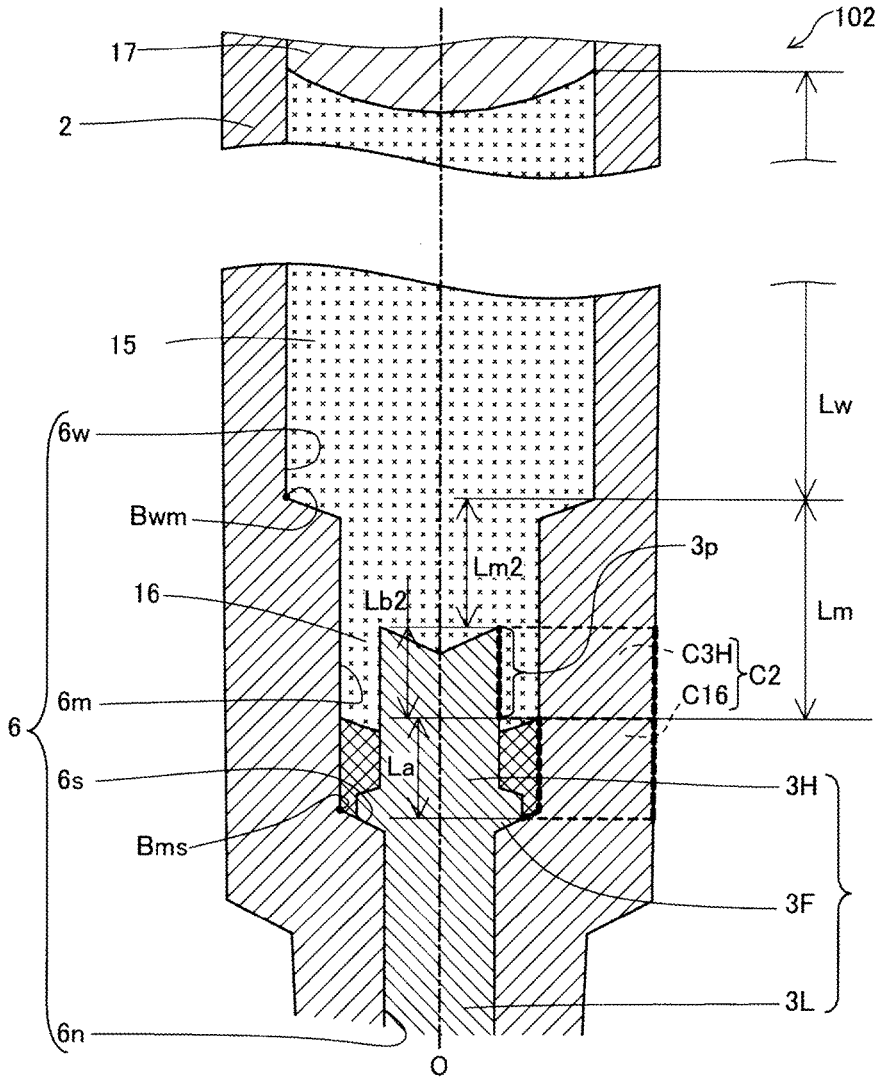
FIG. 5 Enlarged sectional view illustrating an electrically conductive glass seal layer (Embodiment 2) and its vicinity.

Referring to FIG. 5, a spark plug 102 of Embodiment 2 will be described. In Embodiment 2 and Embodiment 3 to be described later, the structural features which are not specifically described are the same as those in Embodiment 1.

The center electrode 3 has a protruding portion 3*p* located on the rear side of the rear end of the electrically conductive glass seal layer 16. Therefore, the protruding portion 3*p* is buried in the resistor 15. The surface of the protruding portion 3*p* contains a predetermined metal or a nickel alloy in the largest amount. The above-described predetermined metal is a metal whose main component is any one of zinc, tin, lead, rhodium, palladium, platinum, copper, gold, antimony, and silver. For example, the above-described nickel alloy is a nickel brazing alloy and contains either boron or phosphorus. This type of nickel alloy or the above-described predetermined metal has a low melting point, and is softened at the temperature at which the filling powder is subjected to hot pressing. Therefore, the contact between the resistor 15 and the center electrode 3 is improved, whereby the state of the electrical connection between the resistor 15 and the center electrode 3 is improved.

In order to form the surface of the protruding portion 3*p* as described above, the center electrode 3 is manufactured using an iron-based material. Thereafter, the head portion 3H is coated by means of plating or the like.

Here, capacitance C2 will be described. As for the capacitance C2, the head portion 3H and the electrically conductive glass seal layer 16 serve as an internal conductor. The capacitance C2 can be expressed as C2=C3H+C16. Capacitance C3H is the capacitance of a capacitor in which the head portion 3H serves as the internal conductor, and the insulator 2 and the resistor 15 serve as the dielectric. Capacitance C16 is the capacitance of a capacitor in which the electrically conductive glass seal layer 16 serves as the internal conductor, and the insulator 2 serves as the dielectric. The capacitances C3H and C16 are connected in parallel. Accordingly, when both the capacitances C3H and C16 are added as described above, the result capacitance is equal to the capacitance C2 which is a composite value.

The length of the capacitor corresponding to the capacitance C16 as measured in the direction of the axial line O is the length La, and is equal to the length La shown in FIG. 2. Furthermore, other parameters are the same as those in Embodiment 1. Therefore, the capacitance of the capacitor formed in a region extending rearward from the forward end of the electrically conductive glass seal layer 16 to a position (hereinafter, referred to as a division position) corresponding to the length La has the same value in Embodiments 1 and 2 (capacitance C16 in Embodiment 2).

In contrast, the capacitance in a region located on the rear side of the division position differs between Embodiments 1 and 2. In the case of Embodiment 2, as described above, the capacitance is the capacitance C3H. The length of the capacitor corresponding to the capacitance C3H as measured in the direction of the axial line O is Lb2, and is shorter than Lb1 in the case of Embodiment 1. Furthermore, the inner diameter a corresponding to the capacitance C3H is the outer diameter of the head portion 3H, and is smaller than the inner diameter of the intermediate diameter portion 6*m*. Therefore, the capacitance on the rear side of the division position in Embodiment 2 is smaller than that in Embodiment 1. As a result, the capacitance C2 becomes smaller than the capacitance C1.

In addition, the electrically conductive glass seal layer 16 is shortened as described above. In this manner, the durability of the center electrode 3 is ensured while the capacitance C2 is decreased. The durability of the center electrode 3 is ensured because the head portion 3H longer than the length of the electrically conductive glass seal layer 16 is buried in the resistor 15 and the electrically conductive glass seal layer 16.

In Embodiment 2 as well, the distance ratio (=Lm/Lw) is set to 20%. Therefore, a second distance ratio (to be described later) is set to a value smaller than 20%. The second distance ratio is the ratio (=Lm2/Lw) between a distance Lm2 and the distance Lw. As illustrated in FIG. 5, the distance Lm2 is the distance from the forward-side end portion of the center electrode 3 to the forward end of the large diameter portion 6*w* in the direction of the axial line O.

In Embodiment 2, the rear end of the center electrode 3 protrudes to the rear side in relation to the rear end of the resistor 15. Accordingly, current hardly flows through a portion of the resistor 15 located forward of the rear end of the center electrode 3, and thus, its electric load does not increase. Therefore, the durability of the resistor 15 can be further improved by shortening the length Lm and additionally, shortening the length Lm2, i.e., decreasing the second distance ratio.

Figure 6:
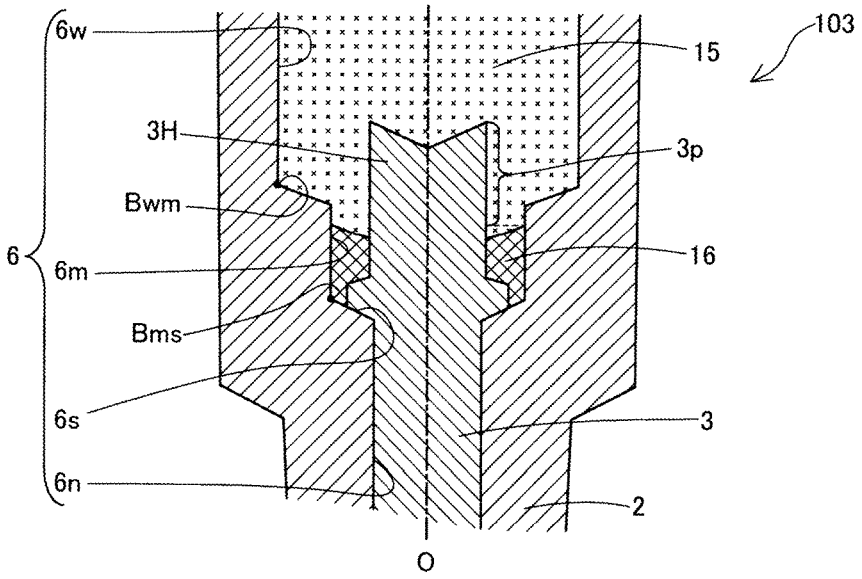
FIG. 6 Enlarged sectional view illustrating an electrically conductive glass seal layer (Embodiment 3) and its vicinity.

Referring to FIG. 6, a spark plug 103 of Embodiment 3 will be described. In the case of the spark plug 103, the rear-side end portion of the protruding portion 3*p* is disposed inside the large diameter portion 6*w*. In other words, the rear-side end portion of the head portion 3H is disposed inside the large diameter portion 6*w*. Furthermore, in other words, the rear-side end portion of the center electrode 3 is disposed inside the large diameter portion 6*w*. The expression "disposed inside the large diameter portion 6*w*" used in the above three sentences can be paraphrased as "located on the rear side of the boundary Bwm" or "located on the rear side of the rear end of the intermediate diameter portion 6*m*."

In the case of Embodiment 3, as in the case of Embodiment 2, in a region on the forward side of the rear end of the center electrode 3, current hardly flows through the resistor 15. In the case of Embodiment 3, the rear-side end portion of the center electrode 3 is disposed inside the large diameter portion 6*w*. Therefore, current hardly flows through a portion of the resistor 15 disposed inside the intermediate diameter portion 6*m*. As a result, it is possible to further improve the durability of the resistor 15 as compared with Embodiments 1 and 2. In Embodiment 3, the distance ratio is also set to 20% (not illustrated).

The present invention is not limited to the above-described embodiments, examples, and modifications, and may be realized in various forms without departing from the scope of the invention. For example, the technical features in the embodiments, examples, and modifications which correspond to the technical features in the modes described in "SUMMARY OF THE INVENTION" can be appropriately replaced or combined in order to solve some of or all the foregoing problems or to achieve some of or all the foregoing effects. A technical feature which is not described as an essential feature in the present specification may be appropriately deleted. For example, the following modifications are possible.

As the material of the electrically conductive glass seal layer 16, an electrically conductive substance other than copper powder may be used. Alternatively, glass powder other than calcium borosilicate glass powder may be used. For example, carbon black or graphite powder may be used as the electrically conductive substance.

The distance ratio may be set to any desired value of 20% or smaller.

In Embodiment 2, the distance ratio may exceed 20% and the second distance ratio may be set to 20% or smaller. Even in this case, it is conceivable that the load life can be ensured.

Various shapes of the intermediate diameter portion 6*m* are conceivable. For example, the wall thickness may be reduced while the inner diameter is maintained. In the case where such a shape is employed, a gap is formed between the insulator and the metallic shell. Since gas or the like inside the combustion chamber enters the gap, the gas or the like serves as a portion of the dielectric. Alternatively, the entire intermediate diameter portion 6*m* may have a tapered shape.

The entire protruding portion 3*p* including the bulk thereof may be formed such that it contains the above-described predetermined metal or the nickel alloy in the largest amount. In this way, the surface of the protruding portion 3*p* can also be formed so as to contain the predetermined metal or the nickel alloy in the largest amount. In addition, the above-described nickel alloy may contain both boron and phosphorus.

DESCRIPTION OF REFERENCE NUMERALS

1 . . . metallic shell
2 . . . insulator
3 . . . center electrode
3F . . . flange portion
3H . . . head portion
3L . . . leg portion
3*p* . . . protruding portion
4 . . . ground electrode
5 . . . thread
6 . . . axial hole
6*m* . . . intermediate diameter portion
6*n* . . . small diameter portion
6*s* . . . step portion
6*sa* . . . step portion
6*w* . . . large diameter portion
6*wa* . . . large diameter portion
13 . . . metallic terminal
15 . . . resistor
16 . . . conductive glass seal layer
17 . . . metallic terminal-side conductive glass seal layer
31 . . . ignition portion
32 . . . forward end portion
101 . . . spark plug
102 . . . spark plug
103 . . . spark plug
Bms . . . boundary
Bwm . . . boundary

What is claimed is:

1. A spark plug comprising:

an approximately tubular metallic shell having a ground electrode at its forward end;

a tubular insulator which is held inside the metallic shell and has an axial hole formed therein and having a small diameter portion, an intermediate diameter portion which is larger in diameter than the small diameter portion and is connected to a rear end of the small diameter portion via a step portion, and a large diameter portion which is larger in diameter than the intermediate diameter portion and is disposed on a rear side of the intermediate diameter portion;

a resistor which is at least partially disposed inside the large diameter portion;

a center electrode which has a flange portion which bulges in a radial direction inside the intermediate diameter portion and is in contact with the step portion, and a leg portion which extends forward from the flange portion and is disposed inside the small diameter portion; and an electrically conductive seal which is disposed on a rear side of the step portion and electrically connects the center electrode and the resistor, the spark plug being characterized in that a rear end of the seal is located inside the intermediate diameter portion, and a rear end of the center electrode is disposed inside the large diameter portion.

2. A spark plug according to claim 1, wherein the center electrode has a protruding portion located on a rear side of the rear end of the seal, and the protruding portion is buried in the resistor.

3. A spark plug according to claim 2, wherein a surface of the protruding portion contains, in a largest amount, a metal whose main component is any one of zinc, tin, lead, rhodium, palladium, platinum, copper, gold, antimony, and silver, or a nickel alloy containing boron or phosphorus.

4. A spark plug according to claim 1, wherein a distance from a forward-side end portion of the resistor to a forward end of the large diameter portion is equal to or shorter than 20% of a distance from the forward end of the large diameter portion to a rear-side end portion of the resistor.

* * * * *